United States Patent [19]

Grant et al.

[11] 4,424,956

[45] Jan. 10, 1984

[54] DRAPABLE, CONSUMABLE, HEAT RETENTION SHIELD FOR HOT METAL CARS

[75] Inventors: Louis A. Grant, Pittsburgh; Arthur F. Trunzo, White Oak, both of Pa.

[73] Assignee: Standard Steel Sponge, Inc., Pittsburgh, Pa.

[21] Appl. No.: 368,277

[22] Filed: Apr. 14, 1982

Related U.S. Application Data

[63] Continuation-in-part of Ser. No. 342,517, Jan. 25, 1982.

[51] Int. Cl.[3] ..... F27D 3/00

[52] U.S. Cl. ..... 266/248; 266/275; 266/280; 266/287; 428/920

[58] Field of Search ..... 266/165, 287, 248, 275, 266/199, 280; 228/59; D9/435; D12/197; 252/62; 428/920

[56] References Cited

U.S. PATENT DOCUMENTS

| | | | |
|---|---|---|---|
| 3,907,260 | 9/1975 | Leatherby | 266/287 |
| 3,979,016 | 9/1976 | Frater | D9/435 X |
| 4,014,532 | 11/1977 | Holley | 266/287 |
| 4,269,619 | 5/1981 | Keil et al. | 266/165 X |
| 4,381,855 | 5/1983 | Ryan | 266/248 |

*Primary Examiner*—G. Ozaki
*Assistant Examiner*—David A. Hey
*Attorney, Agent, or Firm*—Parmelee, Miller, Welsh & Kratz

[57] ABSTRACT

A drapable, consumable, heat retention shield for hot metal cars has a fibrous refractory sheet disposed between two metallic lattices, the lattices connected by fastening means to retain the sheet to form a panel having a bottom wall, upstanding side walls and a flange extending outwardly from the side walls. In one embodiment the metallic lattices substantially cover the fibrous refractory sheet, while in another embodiment cross strips of metallic lattices are used with a combustible supporting frame provided about the periphery of the fibrous refractory sheet to support the same.

8 Claims, 9 Drawing Figures

DRAPABLE, CONSUMABLE, HEAT RETENTION SHIELD FOR HOT METAL CARS

CROSS-REFERENCE TO RELATED APPLICATION

This application is a continuation-in-part of copending application of the present inventors, Ser. No. 342,517 filed Jan. 25, 1982, entitled "Hot Metal Car Heat Retention Shield."

BACKGROUND OF THE INVENTION

As discussed in the parent application, of which this application is a continuation-in-part, the need for inexpensive, efficient and manually placed heat retention shields for hot metal cars has led to various structures. Our earlier heat retention shield was quite sufficient in various situations but, in other situations, where removal and replacement of the shield was required, they did not sufficiently provide suitable properties. Also, at times, portions of the skeletal metallic sheet preferably used would adhere to the mouth of the hot metal car after pouring of the hot metal against the shield and into the car.

The present disposable, consumable, heat metal shield is constructed so as to enable removal and replacement of the shield on the car, when desired, and provides for better draping of the shield, as well as an efficient seal.

BRIEF DESCRIPTION OF THE INVENTION

A drapable, consumable, heat retention shield for retaining the heat of refractories of a hot metal car within the car, has a fibrous refractory sheet disposed between two metallic lattices, and fastening means connecting the lattices together to retain the sheet, to form a drapable panel. The panel has a bottom wall portion, upstanding side walls and a flange extending outwardly from the walls. A cavity is formed in the surface of the panel to be disposed towards the workers, while the second surface bottom wall portion and upstanding walls and flange are exposed to the heat of the hot metal car.

In one embodiment, the metallic lattices extend along the fibrous refractory sheet to substantially enclose the same, while in another embodiment, the metallic lattices are in cross-like strips, with a peripheral support structure of combustible material positioned about the periphery of the panel and affixed to the metallic lattices.

DETAILED DESCRIPTION

Figure 1:
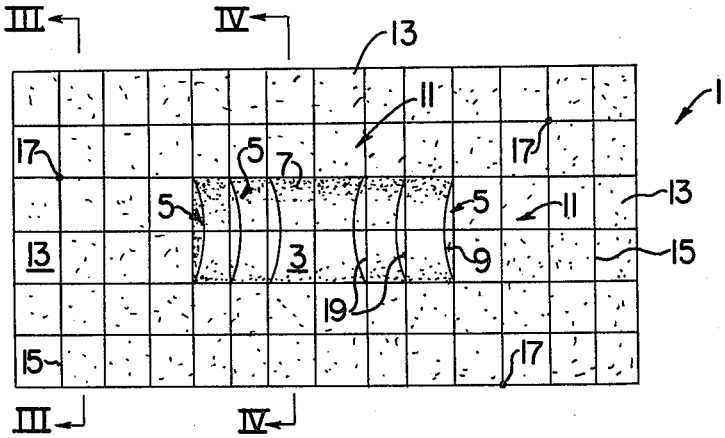
FIG. 1 is a plan view of the top of one embodiment of a consumable heat retention shield of the present invention.
Figure 2:
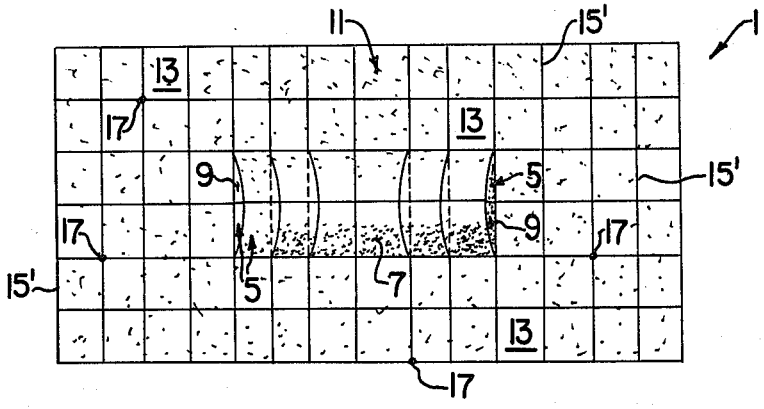
FIG. 2 is a plan view of the bottom or underside of the shield shown in FIG. 1.

The consumable heat retention shield of the present invention is a lightweight, heat insulative, disposable panel formed from a fibrous refractory sheet and metallic lattices.

Referring now to FIGS. 1–4, there is illustrated a consumable heat retention shield 1 which has a bottom wall portion 3, upstanding side walls 5, comprising side walls 7 and end walls 9 about the bottom wall portion 3, and an outwardly extending flange 11, which flange extends outwardly from the side wall portions and are drapable over a hot metal car body as explained more fully hereinafter.

Figure 3:
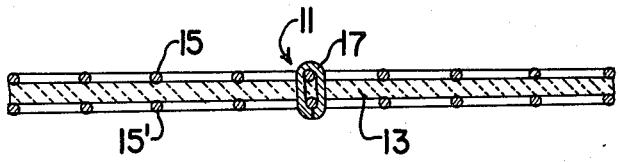
FIG. 3 is a cross-section taken along lines III—III of a heat retention shield similar to FIG. 1.
Figure 4:
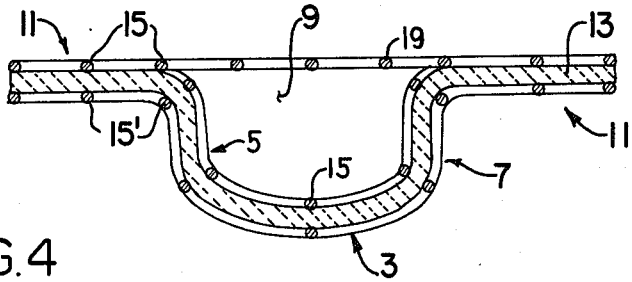
FIG. 4 is a cross-section taken along lines IV—IV of a heat retention shield similar to FIG. 1.
Figure 5:
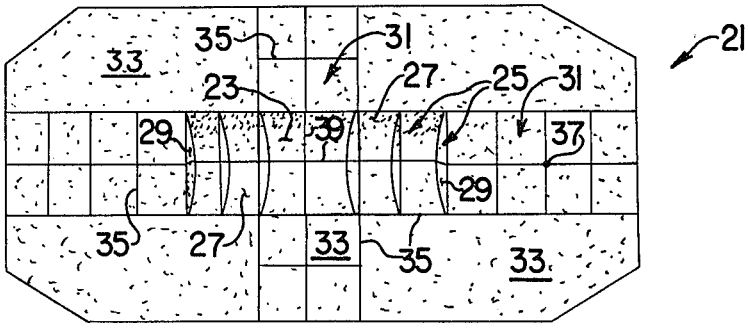
FIG. 5 is a plan view of the top of a further embodiment of a consumable heat retention shield of the present invention.
Figure 6:
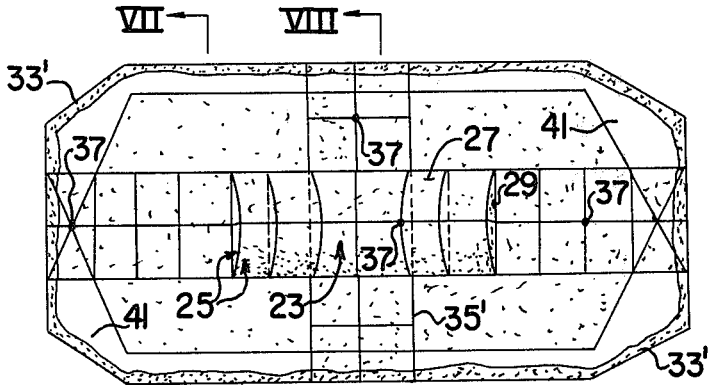
FIG. 6 is a bottom plan view of the bottom or underside of the shield shown in FIG. 5.
Figure 7:
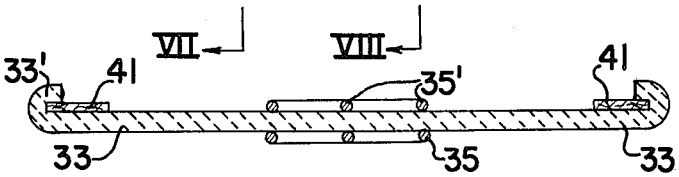
FIG. 7 is a cross-section taken along lines VII—VII of FIG. 6.
Figure 8:
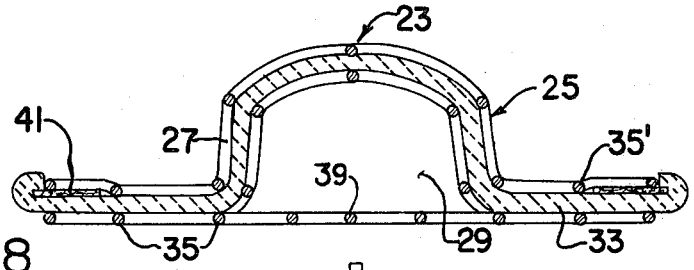
FIG. 8 is a cross-section taken along lines VIII—VIII of a heat retention shield similar to FIG. 6.

The panel 1 is composed of a fibrous refractory sheet 13 which is retained between two metallic lattices 15 and 15'. The first metallic lattice 15 contacts a first or upper surface of the fibrous refractory sheet 13 and conforms with the bottom wall portion 3 and side wall portions 5 to form a cavity surrounded by the flange 11 (FIG. 3). The second metallic lattice 15' contacts a second or lower surface of the fibrous refractory sheet 13 and is adapted for exposure to the hot temperatures of the hot metal car. The two metallic lattices 15 and 15' are connected together by fastening means 17, such as wire staples, so as to form the panel 1 with the fibrous refractory sheet 13 retained between the two lattices. As illustrated, further metallic lattice 19 may extend over the cavity formed by the first metallic lattice 15, this further lattice 19 affixed to the first lattice 15 and serving as a gripping means for use by workmen in holding and placement of the consumable heat retention shield over the aperture of a hot metal car.

The fibrous refractory sheet 13 is a fibrous ceramic material that will protect workmen placing the panel 1 onto a hot metal car and will withstand the hot temperatures of the car, on the order of 2200° to 2400° F. in ferrous metal processing. A particularly useful such fibrous refractory sheet is a ceramic fiber blanket of alumina-silica ceramic fibers sold by A. P. Green Refractories Co. under the trademark "INSWOOL," although other suitable fibrous refractory sheet material may be used.

The metallic lattices are preferably of ferrous metal composition so as to be compatible with the molten metal in ferrous metal processing, and may be in the form of wire fencing.

In the above-described embodiment, the metallic lattices 15 and 15' substantially completely cover the flanged portion 11 of the refractory sheet in a sandwich-like form. In a further embodiment, illustrated in FIGS. 5–8, the metallic lattices are in a cross-like shape and a peripheral support means is used to support the outer edges of the fibrous refractory sheet.

Referring now to FIGS. 5–8, the panel 21 also has a bottom wall portion 23, upstanding wall portion 25, which may comprise side walls 27 and end walls 29, and an outwardly extending flange 31, which flange 31 extends outwardly from the side wall portions and is drapable over a hot metal car body.

The panel 21 is composed of a fibrous refractory sheet 33, here illustrated as an octagonal shaped sheet, which is retained between and supported in its center region by metallic lattices 35 and 35'. The first metallic lattice 35 is a cross-shaped lattice which contacts a first or upper surface of the fibrous refractory sheet 33 and conforms with the bottom wall portion 23, side wall portion 25 and extends outwardly therefrom along the flange 31. The second metallic lattice 35' contacts a second or lower surface of the fibrous refractory sheet 33, and is also a cross shaped lattice. This second metallic lattice is adapted for exposure to the high temperatures of the hot metal car. Fasteners 37 connect the two metallic lattices 35 and 35' to retain the center portions of the fibrous refractory sheet therebetween. Preferably, the cross-strips extend along the length and width of the fibrous refractory sheet, although diagonal or other strips could be used. A further metallic lattice 39 may be provided across the cavity formed by the first metallic lattice 35, which is affixed to lattice 35, to act as a gripping means. With the use of the cross-shaped lattices 35 and 35', the periphery of the fibrous refractory sheet is to be provided with additional support. A peripheral support frame 41 is provided around the periphery of the fibrous refractory sheet 33 to form the outer edge of the flange 31, which peripheral support frame is preferably disposed between the metallic lattice 35' and the fibrous refractory sheet 33 and also affixed to the metallic lattices 35 and 35' by fastening means 37. In order to protect the edges of the peripheral support frame 41, a portion 33' of the fibrous refractory sheet 33 is folded over the edges thereof and also affixed to the peripheral support frame.

The peripheral support frame 41 is produced from a combustible material such as cardboard, lightweight plywood, polymeric material, or the like. The use of such a peripheral support frame, in connection with the cross-like metallic lattices and fibrous refractory sheet minimizes the weight of the heat retention shield and also enhances the drapability and sealing properties of the flange. Upon placement of the heat retention shield on a hot metal car, the peripheral support frame will be consumed due to the heat of the hot metal car and the flange of fibrous refractory material will tend to conform to the shape of the car body and seal the aperture over which the heat retention shield is placed.

Figure 9:
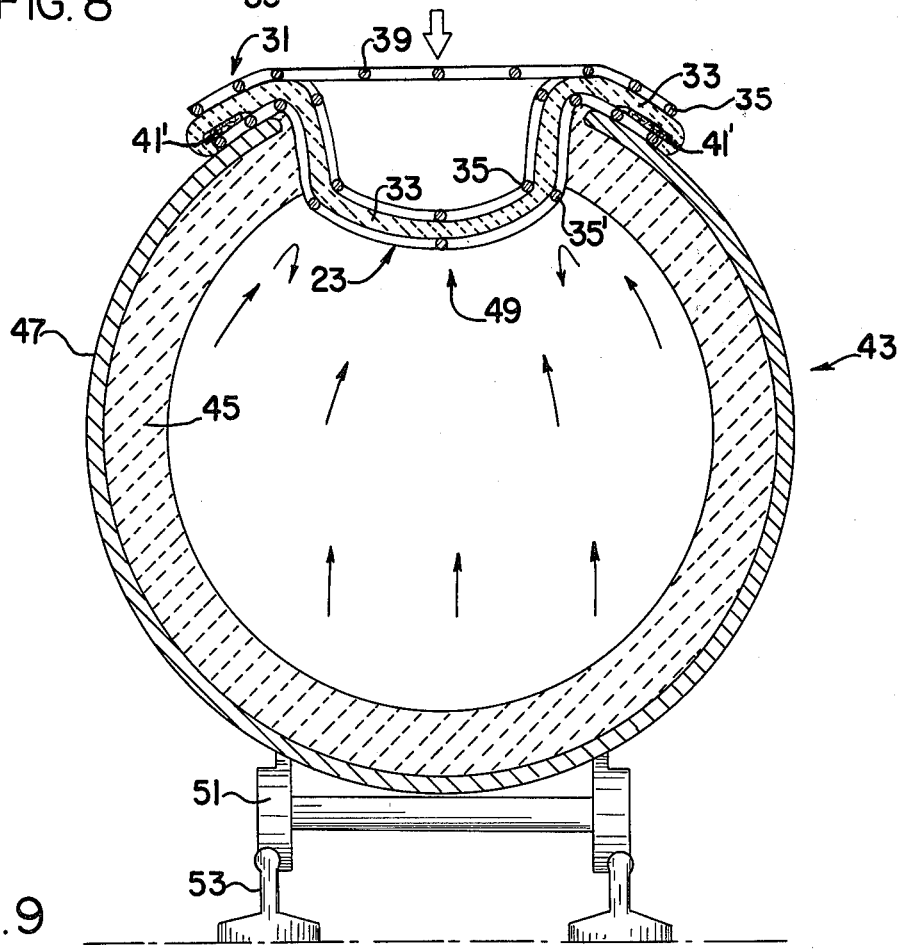
FIG. 9 is a sectional view showing the consumable heat retention shield of FIGS. 5 and 6 in place with the hot metal car positioned for receipt of hot metal.

In the use of the heat retention shield, as shown in FIG. 9, the shield is placed on a hot metal car 43, having a refractory lining 45, metal shell 47 and mouth or aperture 49. The car conventionally travels by means of wheels 51 along tracks 53. The heat retention shield may be initially positioned on the hot metal car while the aperture is substantially horizontally positioned with the workmen holding the heat retention shield 31 by means of further metallic lattice 39, with the shield between them and the car, and advance to the car. The bottom wall portion 23 and side wall portions are inserted into the aperture 49 of the hot metal car 43, with the flange 31 resting on the metal shell 47. The hot metal car 43 is shown in FIG. 9 in position for receipt of hot metal, as indicated by the arrow, with the flange 31 draped over the car body. The combustible material that comprised the peripheral support frame 41 will be consumed, due to the high temperatures of the car, to leave combusted and condensed material 41', such that the initial material loses its supportive properties and the edges of the flange, of fibrous refractory sheet material will conform to the shape of the car body and seal more thoroughly the aperture 49 and thus better retain the heat of the refractories 45 within the hot metal car.

When hot metal is charged into the hot metal car, the metal will force the heat retention shield 21 through the aperture. The metallic lattices will liquefy to become a portion of the molten metal, while the fibrous refractory sheet will be dispersed throughout the molten metal as an insignificant impurity.

The consumable heat retention shield of the present invention is structurally sound so as to enable removal and replacement of the panel over a hot metal car in the event that the lip of the aperture of the car requires cleaning, while still being flexible enough to drape over the car and seal the aperture and be forced completely into the interior of the car upon pouring of metal into the car. The shield is readily supported by a single workman and may be positioned and retained on a hot metal car without the need for hooks, eyelets, or other securement means on either the shield of the hot metal car.

We claim:

1. A lightweight and manually positionable drapable, consumable, heat retention shield for conserving the heat of the interior lining of a hot metal car into which hot metal is to be poured, with an aperture therein for pouring molten metal therein and discharging molten metal therefrom, comprising:

a drapable panel comprised of a fibrous refractory sheet disposed between first and second metallic lattices, with fastening means connecting the lattices together to retain the fibrous refractory sheet therebetween, the panel having a bottom wall portion, upstanding walls about the bottom wall portion, and a flange extending outwardly from the upstanding walls, the first lattice and first surface of the fibrous refractory sheet forming a cavity surrounded by the flange, and the second lattice and second surface of the fibrous refractory sheet adapted for exposure to the hot temperatures of the hot metal car, the bottom wall portion and upstanding wall portion arranged for insertion into the aperture of the hot metal car with the portion of the second lattice on the flange resting on the body portion of the hot metal car such that the shield is positionable on the car and draped thereover to seal said aperture, without the use of mechanical attachment means, and the shield, upon pouring of the hot metal into the car is forced through the aperture and consumed.

2. The drapable, consumable, heat retention shield of claim 1 wherein both of said metallic lattices substantially completely cover the fibrous refractory sheet.

3. The drapable, consumable, heat retention shield of claim 1 wherein a further lattice extends across said cavity, along a plane formed by the flanges, to act as a grasping means to lift and position the shield.

4. The drapable, consumable, heat retention shield of claim 1 wherein said metallic lattices are comprised of a metal compatible with molten iron.

5. The drapable, consumable, heat retention shield of claim 1 wherein said metallic lattices comprise cross-strips along the fibrous refractory sheet.

6. The drapable, consumable, heat retention shield of claim 5 including a peripheral support frame formed of combustible material supporting the periphery of the fibrous refractory sheet.

7. The drapable, consumable, heat retention shield of claim 6 wherein said cross-strips extend along the length and width of the fibrous refractory sheet.

8. The drapable, consumable, heat retention shield of claim 6 wherein said peripheral support frame is intermediate the fibrous refractory sheet and said second of said lattices.

* * * * *

REEXAMINATION CERTIFICATE (1154th)

United States Patent [19] [11] B1 4,424,956

Grant et al. [45] Certificate Issued Nov. 14, 1989

[54] DRAPABLE CONSUMABLE HEAT RETENTION SHIELD FOR HOT METAL CARS

[75] Inventors: Louis A. Grant, Pittsburgh; Arthur F. Trunzo, White Oak, both of Pa.

[73] Assignee: Standard Steel Sponge

Reexamination Request:
No. 90/001,514, May 18, 1988

Reexamination Certificate for:

| | |
|---|---|
| Patent No.: | **4,424,956** |
| Issued: | **Jan. 10, 1984** |
| Appl. No.: | **368,277** |
| Filed: | **Apr. 14, 1982** |

Related U.S. Application Data

[63] Continuation-in-part of Ser. No. 342,517, Jan. 25, 1982.

[51] Int. Cl.[4] ..... F27D 3/00

[52] U.S. Cl. ..... 266/248; 266/275; 266/280; 266/287; 428/920

[58] Field of Search ..... 266/275, 287, 248, 165, 266/240; 414/164, 162; 220/254, 257, 258, 265

[56] References Cited

U.S. PATENT DOCUMENTS 4,381,855 5/0383 Ryan ..... 266/248

*Primary Examiner*—Scott Kastler

[57] ABSTRACT

A drapable, consumable, heat retention shield for hot metal cars has a fibrous refractory sheet disposed between two metallic lattices, the lattices connected by fastening means to retain the sheet to form a panel having a bottom wall, upstanding side walls and a flange extending outwardly from the side walls. In one embodiment the metallic lattices substantially cover the fibrous refractory sheet, while in another embodiment cross strips of metallic lattices are used with a combustible supporting frame provided about the periphery of the fibrous refractory sheet to support the same.

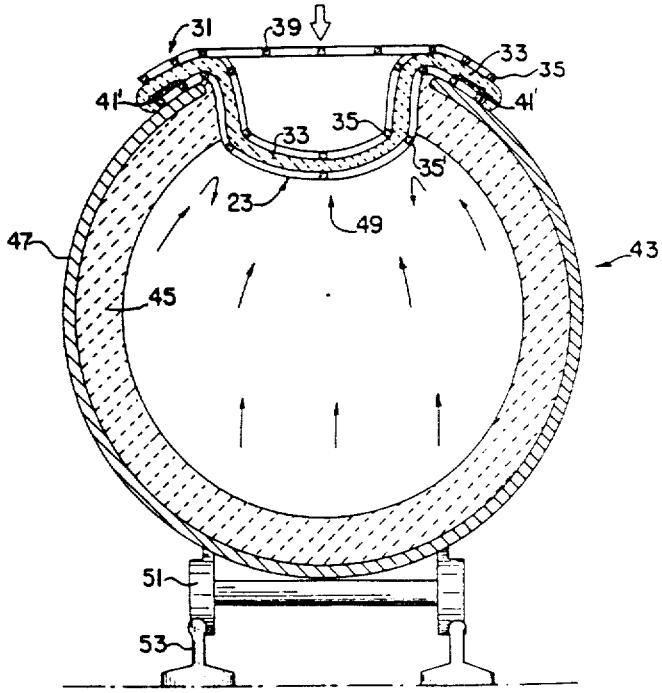

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–8 are cancelled.

New claims 9–11 are added and determined to be patentable.

*9. A lightweight manually positionable, drapable, consumable, heat retention shield for conserving the heat of the interior lining of a hot metal car into which hot metal is to be poured through an aperture in the hot metal car, said heat retention shield comprising:*

*a panel having a first metallic lattice, a second metallic lattice spaced from said first metallic lattice and a fibrous refractory sheet located between said first metallic lattice and said second metallic lattice, said metallic lattices comprising cross-strips along said fibrous refractory sheet and fastening means connecting said first and second metallic lattices to retain said fibrous refractory sheet therebetween, said panel being formed with a depressed cavity spaced from the periphery thereof, said depressed cavity having a bottom wall and side walls and end walls extending upwardly from the periphery of said bottom wall, and a flange extending outwardly away from said sidewalls and said end walls, a peripheral support frame of combustible material supporting said periphery of said fibrous refractory sheet, whereby said bottom wall, said side walls and said end walls are adapted to extend downwardly from said panel into the aperture in a hot metal car when the heat retention shield is in place on a hot metal car and said outwardly extending flange of said panel is adapted to rest on the exterior surface of a hot metal car when the heat shield is in place on the car and is draped thereover, said heat retention shield being held in place on the hot metal car by placing said bottom wall, said side walls and said end walls of said depressed cavity into the aperture in the hot metal car without any mechanical means attaching said heat retention shield to the hot metal car and whereby hot metal poured into the hot metal car through the aperture is poured into said depressed cavity to force the heat shield through the aperture into the hot metal car wherein it is consumed.*

*10. The drapable, consumable, heat retention shield of claim 9 wherein said cross-strips extend along the length and width of said fibrous refractory sheet.*

*11. The drapable, consumable, heat retention shield of claim 9 wherein said peripheral support frame is intermediate said fibrous refractory sheet and said second metallic lattice.*

* * * * *